United States Patent [19]

Theros

[11] 4,244,538

[45] Jan. 13, 1981

[54] SPOOL

[75] Inventor: Brian S. Theros, Lyons, Ill.

[73] Assignee: Container Corporation of America, Chicago, Ill.

[21] Appl. No.: 57,181

[22] Filed: Jul. 13, 1979

[51] Int. Cl.[3] ..... B65H 75/14
[52] U.S. Cl. ..... 242/118.8
[58] Field of Search ..... 206/396, 400, 415, 416; 242/118.8, 71.8, 68.5, 118.4

[56] References Cited

U.S. PATENT DOCUMENTS

| | | | |
|---|---|---|---|
| 2,724,538 | 11/1955 | Schweich | 206/396 |
| 3,876,073 | 4/1975 | Herbetko | 206/400 |
| 3,958,775 | 5/1976 | Liga | 242/118.8 |

*Primary Examiner*—William T. Dixson, Jr.
*Attorney, Agent, or Firm*—Richard W. Carpenter

[57] ABSTRACT

A spool is formed from paperboard and has a core and a pair of end members releasably attached to the ends of the core.

1 Claim, 5 Drawing Figures

SPOOL

BACKGROUND OF THE INVENTION

1. Field of the Invention

This invention relates to spools and, more particularly, to spools formed from paperboard, or the like.

2. The Prior Art

The prior art is believed to be best exemplified by U.S. Patents to A. Billstein, U.S. Pat. No. 811,899, and W. T. Nye, U.S. Pat. No. 2,799,458. Both of these patents disclose spools. While the structure of this application in general appearance resembles the structure of Nye, there are significant differences and improvements incorporated in the present structure. One of the significant improvements over the known art relates to provision of a central opening in the end members through which the core extends and is placed into a locking engagement with the end members. The present construction provides a substantially stronger spool without the use of any additional material, such as paperboard, or the like.

The present construction permits easy assembling of the core and the end members so that the spool can be shipped as flat individual parts from spool manufacturer's plant to the user's location.

SUMMARY OF THE INVENTION

A spool is formed from paperboard and has a core and a pair of end members releasably attached to the opposite ends of the core. Each end member has a central opening and a plurality of slots. The core extends through the central opening while locking tabs, attached to the end flaps of the walls forming the core, are received in the slots in the end members thereby securing the core to the end members.

DRAWINGS

Figure 1:
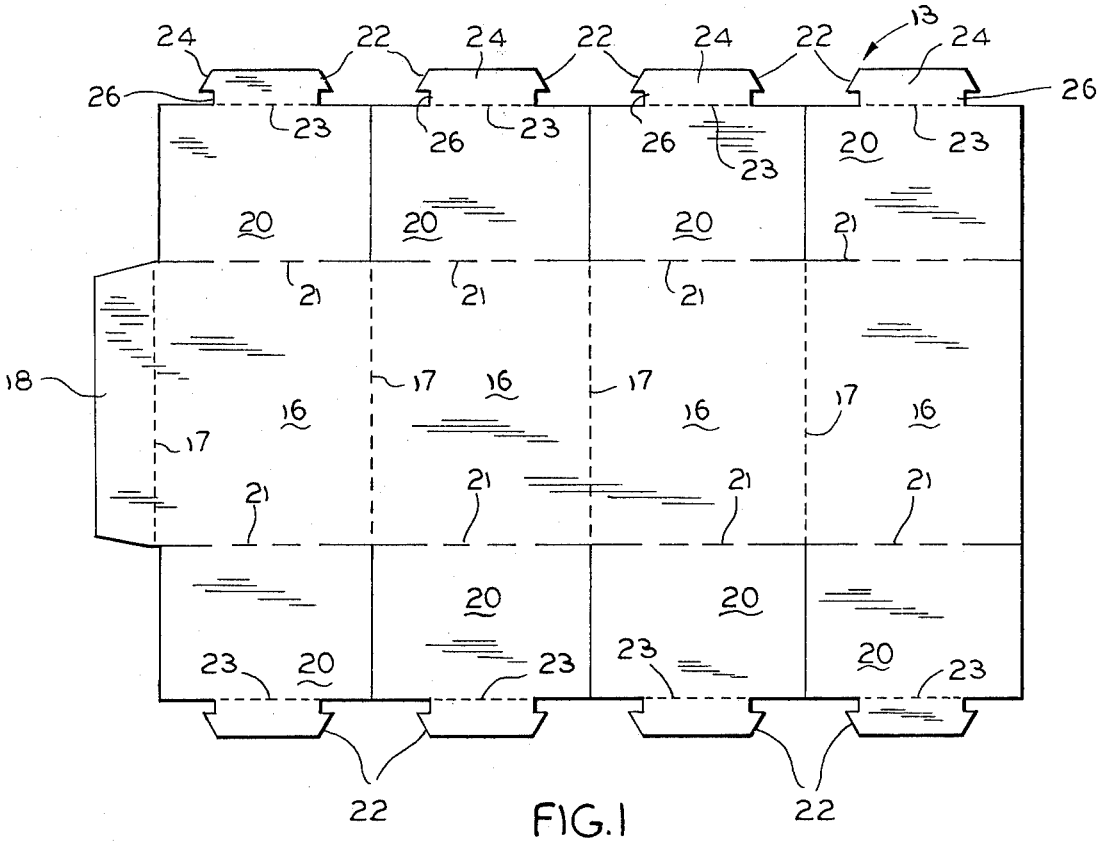
FIG. 1 is a plan view of a blank for forming a core of the spool of the present invention.
Figure 2:
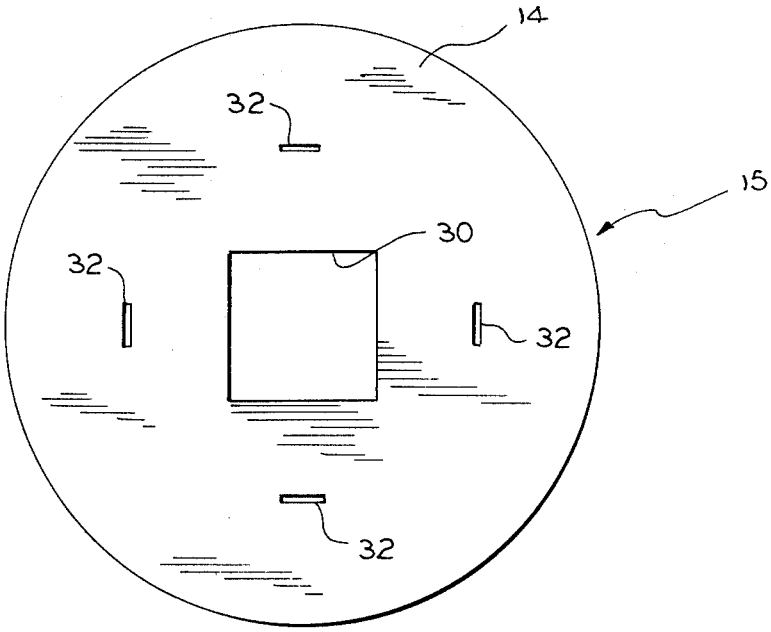
FIG. 2 is a plan view of a blank for forming an end member of the spool.
Figure 3:
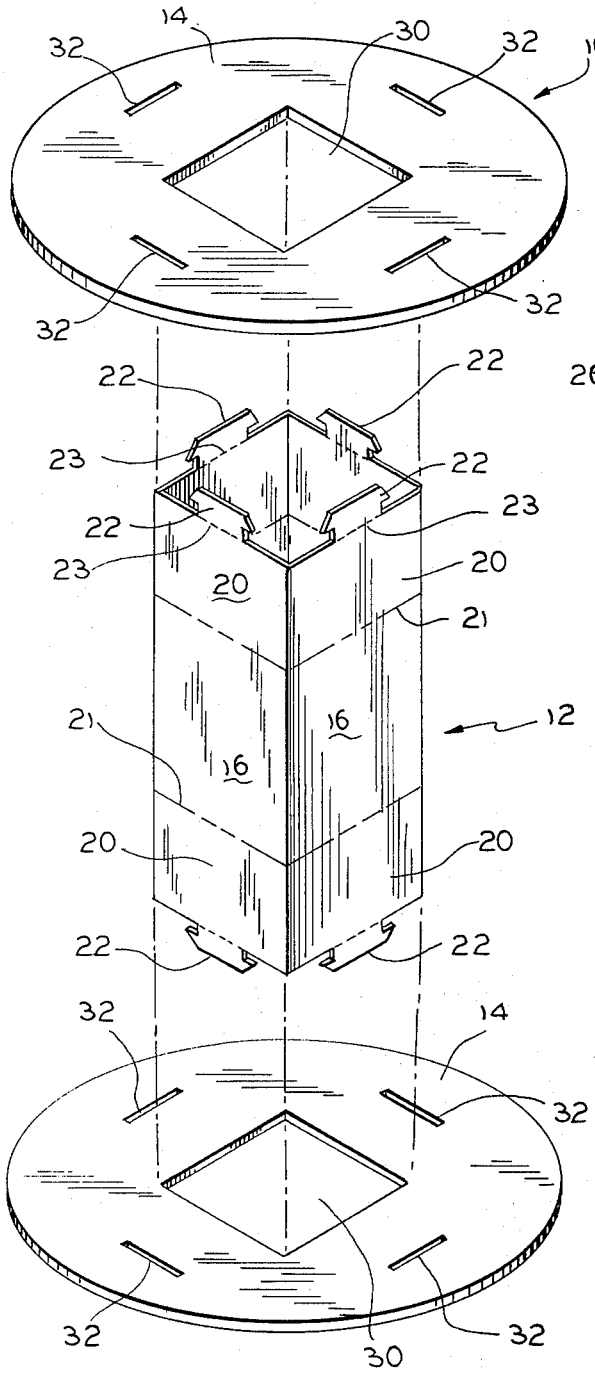
FIG. 3 is an exploded perspective view of the spool formed from the blanks of FIGS. 1 and 2.

Referring now to the drawings, there is shown a spool 10 formed from blanks of paperboard, or the like, illustrated in FIGS. 1 and 2.

The spool 10 has a core 12 formed from a blank 13 and a pair of end members 14 formed from a pair of identical blanks 15.

The core 12 is formed from a plurality of walls 16 foldably interconnected along fold line 17 and, together with a glue flap 18 forming a hollow, multisided, tubular structure.

Each of the walls 16 has an end flap 20 foldably joined to the opposite ends thereof along fold lines 21. The end flaps have locking tabs 22 hinged to the end edges thereof along hinge lines 23. These locking tabs have head portions 24 and reduced neck portions 26 which join the tabs to the end flaps 20 at the hinge lines 23. The purpose and function of the locking tabs will become apparent from further description of the present invention.

In the exemplary embodiment illustrated, a pair of identical end members 14 are each formed with a central opening 30 adapted to receive end portions of the core 12. In addition to the central opening 30, the end members have a plurality of slots 32 formed therein for receiving and releasably retaining the locking tabs 22 when the core 12 is positioned so as to extend into the opening 30.

Figure 4:
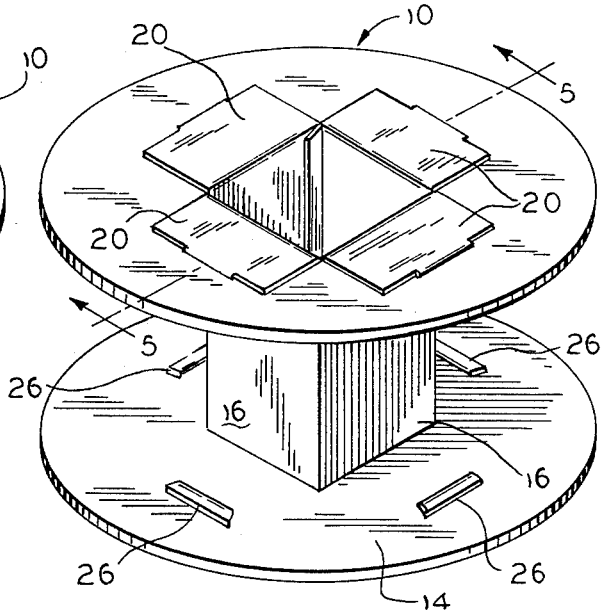
FIG. 4 is a perspective view of an assembled spool.
Figure 5:
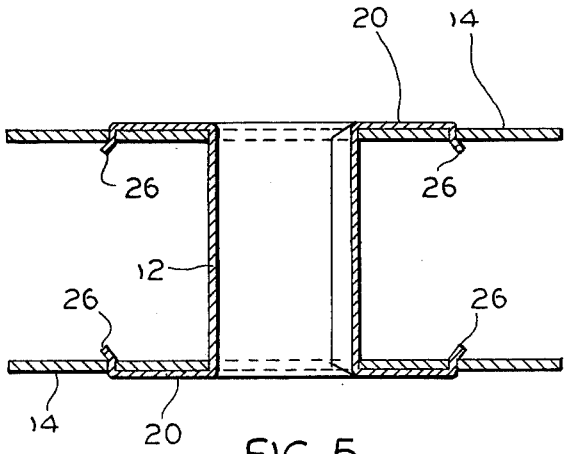
FIG. 5 is a sectional view taken generally along the line 5—5 of FIG. 4.

As best seen in FIGS. 4 and 5, the end flaps are folded into a normal relationship with respect to the core 12 and positioned so as to contact exterior surfaces of the end members 14. The heads 24 of the locking tabs 22 extend through the slots 32 and secure the core 12 to the end members 14.

I claim:

1. A spool formed from a plurality of blanks of paperboard or the like, comprising:

(a) a hollow core of rectangular cross section formed from foldably interconnected walls to define a tube;

(b) each wall having an end flap at each end thereof foldable with respect to said wall and having locking tabs at the ends thereof;

(c) a pair of end members adapted to be secured to said hollow core, each of said end members having a rectangular opening therein closely fitting the walls of said core;

(d) each of said end members having slots, each of said slots being spaced from the openings in the end members by a distance equal to the length of said flaps;

(e) said end flaps being foldable against said end walls with the locking tabs inserted into said slots to maintain said core and said end walls in assembled relationship.

* * * * *